US008350155B2

(12) United States Patent
Kobayashi et al.

(10) Patent No.: US 8,350,155 B2
(45) Date of Patent: Jan. 8, 2013

(54) WIRE CONNECTION SLEEVE, A WIRE CONNECTION SLEEVE PRODUCING METHOD, A REPAIR WIRE PRE-CONNECTED WITH A WIRE CONNECTION SLEEVE BY CRIMPING AND A WIRE CONNECTING METHOD

(75) Inventors: Kazumasa Kobayashi, Yokkaichi (JP); Tetsuya Aihara, Yokkaichi (JP); Satoshi Morikawa, Yokkaichi (JP); Hideki Matsunaga, Yokkaichi (JP); Toshiya Mori, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 481 days.

(21) Appl. No.: 12/631,251

(22) Filed: Dec. 4, 2009

(65) Prior Publication Data

US 2010/0147585 A1 Jun. 17, 2010

(30) Foreign Application Priority Data

Dec. 16, 2008 (JP) ..... 2008-319346

(51) Int. Cl.
*H01R 4/00* (2006.01)

(52) U.S. Cl. ..... 174/84 R; 174/88 C

(58) Field of Classification Search ..... 174/74 R, 174/74 A, 77 R, 80, 84 R, 84 C, 88 R; 29/868, 29/869, 871, 873
See application file for complete search history.

(56) References Cited

U.S. PATENT DOCUMENTS

| | | | | | |
|---|---|---|---|---|---|
| 2,429,585 | A | * | 10/1947 | Rogoff | 174/84 C |
| 2,655,641 | A | | 10/1953 | Asaff | |
| 2,802,257 | A | | 8/1957 | Holtzapple | |
| 2,832,816 | A | | 4/1958 | Curtiss | |
| 3,143,595 | A | * | 8/1964 | Martin | 174/84 C |
| 3,390,227 | A | * | 6/1968 | Shlesinger, Jr. | 174/84 C |
| 3,404,216 | A | * | 10/1968 | Amann et al. | 174/84 C |
| 3,596,231 | A | * | 7/1971 | Melton | 439/426 |
| 3,626,363 | A | * | 12/1971 | McIver et al. | 439/880 |
| 3,708,611 | A | * | 1/1973 | Dinger | 174/84 C |
| 4,151,364 | A | * | 4/1979 | Ellis | 174/84 C |
| 4,208,788 | A | * | 6/1980 | Siden | 29/862 |
| 4,341,921 | A | * | 7/1982 | Simpson | 174/84 R |
| 4,595,724 | A | * | 6/1986 | Koblitz | 524/409 |
| 4,829,146 | A | * | 5/1989 | Duve | 174/94 R |
| 4,959,508 | A | * | 9/1990 | McGrane | 174/84 C |
| 5,278,354 | A | * | 1/1994 | Lhomme | 174/84 R |
| 5,393,932 | A | * | 2/1995 | Young et al. | 174/84 R |
| 5,422,438 | A | * | 6/1995 | Lamome | 174/84 C |
| 5,509,202 | A | * | 4/1996 | Abdow | 29/871 |
| 5,749,756 | A | * | 5/1998 | Vockroth et al. | 439/879 |
| 6,658,735 | B2 | * | 12/2003 | Ito | 29/868 |
| 7,256,348 | B1 | * | 8/2007 | Endacott | 174/84 R |
| 2004/0074667 | A1 | * | 4/2004 | Endacott | 174/84 R |

FOREIGN PATENT DOCUMENTS

| | | |
|---|---|---|
| FR | 2917244 | 12/2008 |
| GB | 750703 | 6/1953 |
| GB | 792008 | 3/1958 |
| JP | 2008-066034 | 3/2008 |

* cited by examiner

*Primary Examiner* — William Mayo, III
(74) *Attorney, Agent, or Firm* — Gerald E. Hespos; Michael J. Porco

(57) ABSTRACT

A wire connection sleeve includes a pipe-like outer tube (20) and an inner tube (30) inserted inside this outer tube (20). The inner tube (30) is formed by winding a sheet-like metal material (P) formed with projections or recesses into a tubular shape with both ends being open, and a longitudinal middle part of this inner tube (30) serves as an inner-tube small-diameter portion (32) which is so squashed or deformed that the opening size thereof is smaller than those of the opposite longitudinal ends.

10 Claims, 10 Drawing Sheets

WIRE CONNECTION SLEEVE, A WIRE CONNECTION SLEEVE PRODUCING METHOD, A REPAIR WIRE PRE-CONNECTED WITH A WIRE CONNECTION SLEEVE BY CRIMPING AND A WIRE CONNECTING METHOD

BACKGROUND OF THE INVENTION

1. Field of the Invention

The invention relates to a wire connection sleeve for connecting wires, a wire connection sleeve producing method, a repair wire pre-connected with a wire connection sleeve by crimping and a wire connecting method.

2. Description of the Related Art

A wire may be cut while handling a wiring harness at a vehicle factory and dealer or the like then may be required to connect another wire for repair. Japanese Unexamined Patent Publication No. 2008-66034 discloses a method for connecting first and second wires by inserting the wires into opposite ends of a seamless metallic sleeve. The sleeve then is crimped to connect the conductors.

Oxide films formed on the outer surfaces of the conductors and hence are present between the conductors and the sleeve. The oxide films increase contact resistance between the conductors and reduce the connection reliability of connected parts of the wires.

Conductors made of copper alloy conventionally have been used in the field of wiring harnesses and the like. However, conductors made of aluminum alloy have been used more frequently in recent years for weight saving and other reasons. Oxide films are more difficult to remove from aluminum alloy than from copper alloy. Thus, there has been an increasing demand to improve connection reliability of connected parts of wires by removing oxide films of conductors.

The present invention was developed in view of the above situation and an object thereof is to provide a wire connection sleeve, a wire connection sleeve producing method, a repair wire pre-connected with a wire connection sleeve by crimping and a wire connecting method which can improve the connection reliability of connected parts of wires.

SUMMARY OF THE INVENTION

The invention relates to a wire connection sleeve with a substantially pipe-like outer tube and an inner tube at least partly inserted inside the outer tube. The inner tube is formed by winding a sheet-like conductive (preferably metal) material into a tubular shape with open ends. The inner tube has at least one projection and at least one recess. A longitudinal intermediate part of the inner tube is squashed or deformed to an opening size that is smaller than the openings at the opposite longitudinal ends.

The conductors are inserted into the opposite ends of the inner tube and the inner tube then is crimped or deformed to connect the conductors. The projections and recesses of the inner tube break oxide films of the conductors to expose conductive surfaces that contact the inner tube come. Thus, contact resistance between the conductors and the inner tube is reduced as compared with the case where the oxide films are present between the conductors and the inner tube.

Further, the cross-sectionally small intermediate part of the inner tube defines a partition and can prevent a crimping or deforming operation with the conductors of the wires placed one over the other or interacting with each other in the inner tube. As a result, sufficient contact areas of the conductors of the wires and the inner tube can be ensured.

A part of the outer tube located outside the small-diameter intermediate portion of the inner tube portion may also be squashed or deformed to define a small-diameter portion that engages the inner tube in a longitudinal direction. Thus, the inner tube is held so as not come out of the outer tube, and the inner and outer tubes can be handled together. As a result, the wires can be connected easily.

At least one of the substantially opposite circumferential ends of the inner tube may be folded inwardly. Accordingly, the conductors of the wires can be inserted at opposite sides of the folded portion to increase contact areas of the conductors and the inner tube. As a result, connection reliability at the connected parts of the wires can be improved further.

The folded portion may divide the inner tube into two wire insertion spaces that may be substantially equally dimensioned.

The projections and recesses may be elongated projections or grooves extending substantially in a circumferential direction of the inner tube.

The small-diameter portion of the inner tube may be squashed or deformed until the inner surface thereof is held substantially in close contact.

Opposite longitudinal ends of the small-diameter portion of the inner tube may be formed into two wire crimping portions to be crimped into connection with respective wires. The wire crimping portions may have substantially the same opening size and/or longitudinal length. The opening size of the wire crimping portions may be substantially constant in a longitudinal direction.

The invention also relates to a repair wire pre-connected with the above-described wire connection sleeve by crimping. A conductor of one wire is connected with one of the ends of the inner tube by crimping, and the other end of the inner tube is open.

The invention also relates to a method for producing a wire connection sleeve. The method comprises winding a sheet-like conductive material formed with one or more projections and/or one or more recesses into a tubular shape with both ends being substantially open to form an inner tube. The method then includes deforming a small-diameter portion forming step of squashing a longitudinal intermediate part of the outer tube with the inner tube at least partly inserted inside the outer tube, thereby forming an inner-tube small-diameter portion whose opening size is smaller than those of the opposite longitudinal ends of the inner tube and forming an outer-tube small-diameter portion engaged with the inner tube in a longitudinal direction substantially in a part of the outer tube located outside the inner-tube small-diameter portion. Thus, the inner-tube small-diameter portion and the outer-tube small-diameter portion can be formed simultaneously.

The invention also relates a method for connecting wires using a wire connection sleeve. The method may include forming a substantially pipe-like outer tube and an inner tube at least partly inserted inside the outer tube. The inner tube may be formed by winding a sheet-like conductive material formed with one or more projections and/or one or more recesses into a tubular shape with both ends being substantially open and a longitudinal intermediate part of the inner tube being deformed to define a small-diameter portion with an opening that is smaller than openings at the opposite longitudinal ends. Conductors of wires are inserted into the ends of the inner tube and the inner tube then is crimped or deformed to connect the wires.

The method may include folding at least one end of the opposite circumferential ends of the inner tube inwardly. The conductors may then be divided and inserted at opposite sides of the folded portion prior to crimping or deforming.

The conductors of the wires may be made of aluminum and/or aluminum alloy.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
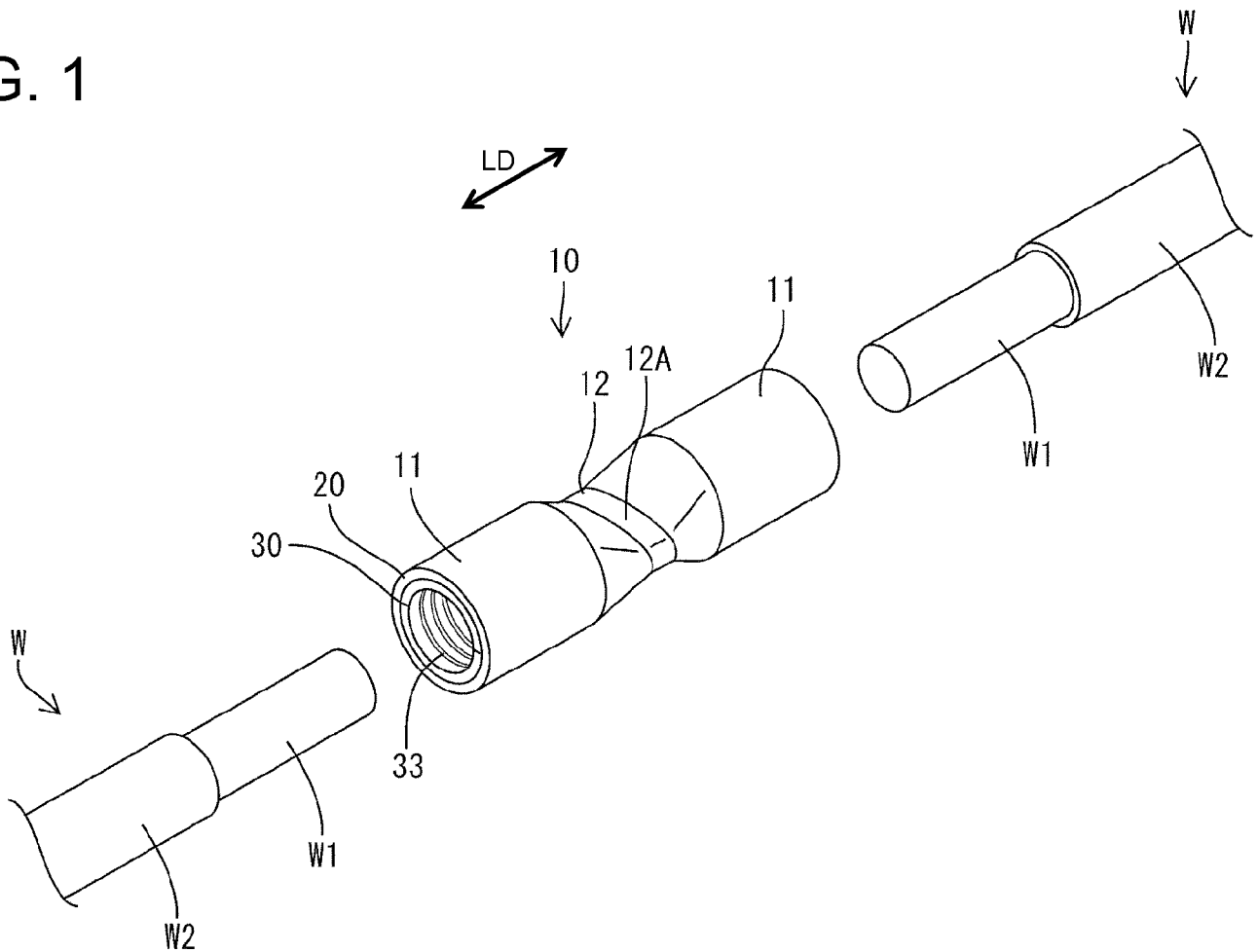
FIG. 1 is a perspective view showing a wire connection sleeve according to a first embodiment and end portions of wires.
Figure 2:
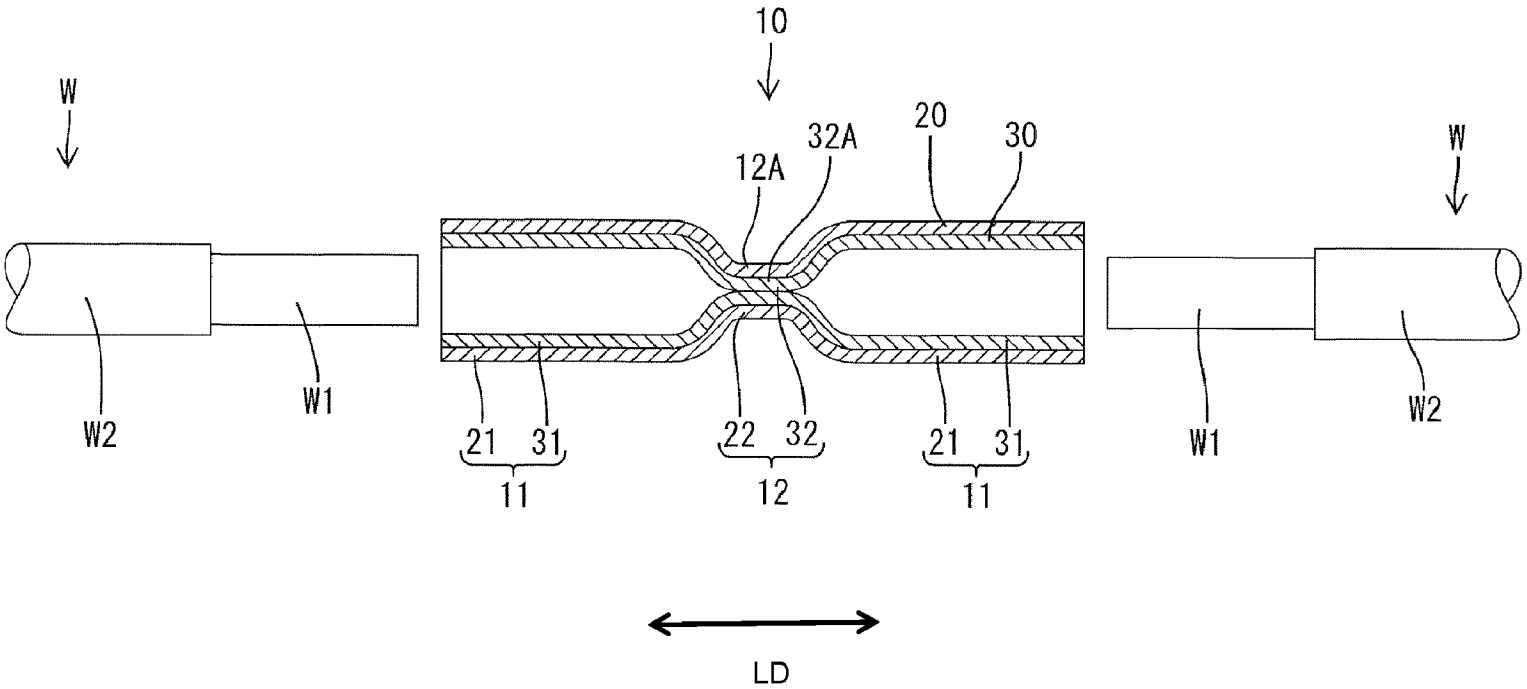
FIG. 2 is a section showing the wire connection sleeve and the end portions of the wires.

A wire connection sleeve 10 according to a first embodiment is illustrated in FIGS. 1 to 6 and is configured for connecting at least two wires W. The wire connection sleeve 10 has a double-tube structure comprising an outer tube 20 and an inner tube 30 inserted inside the outer tube 20. The outer and inner tubes 20, 30 preferably are in close contact with each other over their entirety.

The wire connection sleeve 10 is a tube that is open at the opposite ends. The opposite end portions of the wire connection sleeve 10 define wire crimping portions 11. The conductors W1 of the respective wires W are inserted into the crimping portions 11 and crimp-connected. The two wire crimping portion 11 have substantially the same opening size and longitudinal length. The opening size of the wire crimping portions 11 is substantially constant in a longitudinal direction LD.

A cross-sectionally small portion 12 is defined at an intermediate part of the wire connection sleeve 10 in the longitudinal direction LD and defines an opening cross-section that is smaller than the wire crimping portions 11. The opening of the cross-sectionally small portion 12 becomes gradually smaller toward the longitudinal center from the respective wire crimping portions 11 and the inner surface of the cross-sectionally small portion 12 is closed in the center (see FIG. 2). A part of the cross-sectionally small portion 12 where the inner surface of the wire connection sleeve 10 closely contacts is deformed from the opposite widthwise sides (e.g. upper and lower sides in FIG. 2) and is substantially flat. The small portion 12 partitions the two wire crimping portions 11 from each other.

Figure 3:
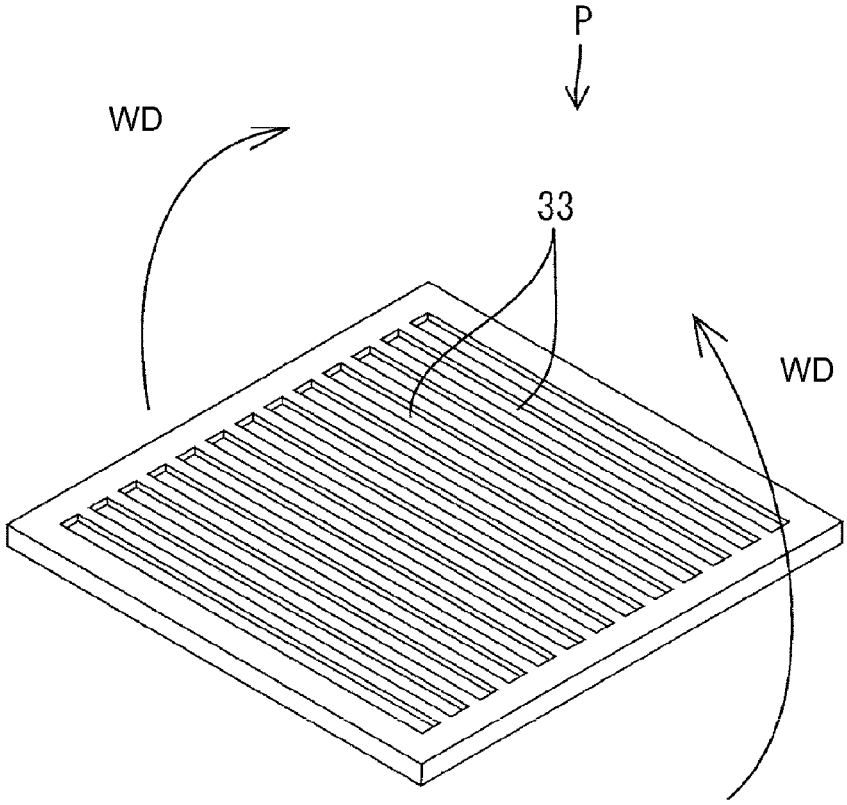
FIG. 3 is a perspective view showing a metal plate before being formed into an inner tube.

The inner tube 30 is formed by winding a substantially rectangular metal plate or blank P formed with recesses 33 as shown in FIG. 3 (for example, a tin-plated metal plate made of copper alloy) into a substantially tubular shape with both ends open. The opposite circumferential edges of the plate P are butted against each other (see FIG. 4).

The opposite longitudinal ends of the inner tube 30 define inner-tube wire crimping portions 31 that define inner parts of the wire crimping portions 11. The two inner-tube wire crimping portions 31 have substantially the same opening size and longitudinal dimension. The opening size of the inner-tube wire crimping portions 31 is substantially constant in the longitudinal direction LD.

An intermediate part of the inner tube 30 in the longitudinal direction LD defines a cross-sectionally small inner-tube portion 32 with an opening size smaller than that of the inner-tube wire crimping portions 31. The cross-sectionally small inner-tube portion 32 defines an inner side of the cross-sectionally small portion 12 of the wire connection sleeve 10. The cross-sectionally small inner-tube portion 32 is formed with an opening size that becomes gradually smaller toward the longitudinal center from the respective inner-tube wire crimping portions 31 and the inner surface thereof is closed in an intermediate position (see FIG. 2). An inner-tube closed portion 32A is defined at a part where the inner surface of the inner tube 30 is held in close contact and is substantially flat.

Recesses 33 are formed side by side in the inner surface of the inner tube 30 and receive the conductors W1 of the wires W as a crimping operation is performed. The recesses 33 are grooves that extend in the circumferential direction of the inner tube 30, which is substantially orthogonal to the longitudinal direction LD of the wire connection sleeve 10 and the wires W. The length of each recess 33 is set so that the recesses 33 extend over substantially the entire circumference of the inner surface of the inner tube 30. The recesses 33 are at substantially constant intervals in the longitudinal direction LD of the inner tube 30. Each recess 33 is substantially trapezoidal in cross section and has a width that gradually increases toward the opening end edge. The recesses 33 are formed by press-working the metal plate or blank P using a mold (not shown) formed with elongated projections.

The outer tube 20 is a seamless pipe made of an electrically conductive metal and has a substantially cylindrical shape slightly larger than the inner tube 30 forming outer parts of the wire crimping portions 11. The two outer-tube wire crimping portions 21 have substantially the same opening size and longitudinal dimension. The opening size of the outer-tube wire crimping portions 21 is substantially constant in the longitudinal direction.

An cross-sectionally small outer-tube portion 22 is defined at a substantially central part of the outer tube 20 in the longitudinal direction LD and is between the inner-tube wire crimping portions 31. The opening size of the cross-sectionally small outer-tube portion 22 becomes gradually smaller toward the longitudinal center from the respective outer-tube wire crimping portions 21 and an opening corresponding to the width of the inner-tube small-diameter portion 32 is formed substantially in the center. The cross-sectionally small outer-tube portion 22 is part of the small-diameter portion 12 of the wire connection sleeve 10.

The wire connection sleeve 10 is formed by providing a metal plate or blank P with the recesses 33 and winding the metal plate P so that the recesses 33 are on the inner surface, thereby forming the inner tube 30 with the both ends being open. Winding directions of the metal plate P are in directions to bring the opposite end edges of the metal plate P along an extending direction of the recesses closer to each other (the winding directions WD of the metal plate P are shown by arrows in FIG. 3). The opposite ends edges of the metal plate P are butted against each other or arranged close to each other to form a hollow cylindrical shape having a substantially O- or C-shaped cross section.

The cross-sectionally small inner-tube portion 32 is formed by squashing or deforming a longitudinal intermediate part of the inner tube 30 until the inner surface of the inner tube 30 is substantially closed.

Figure 4:
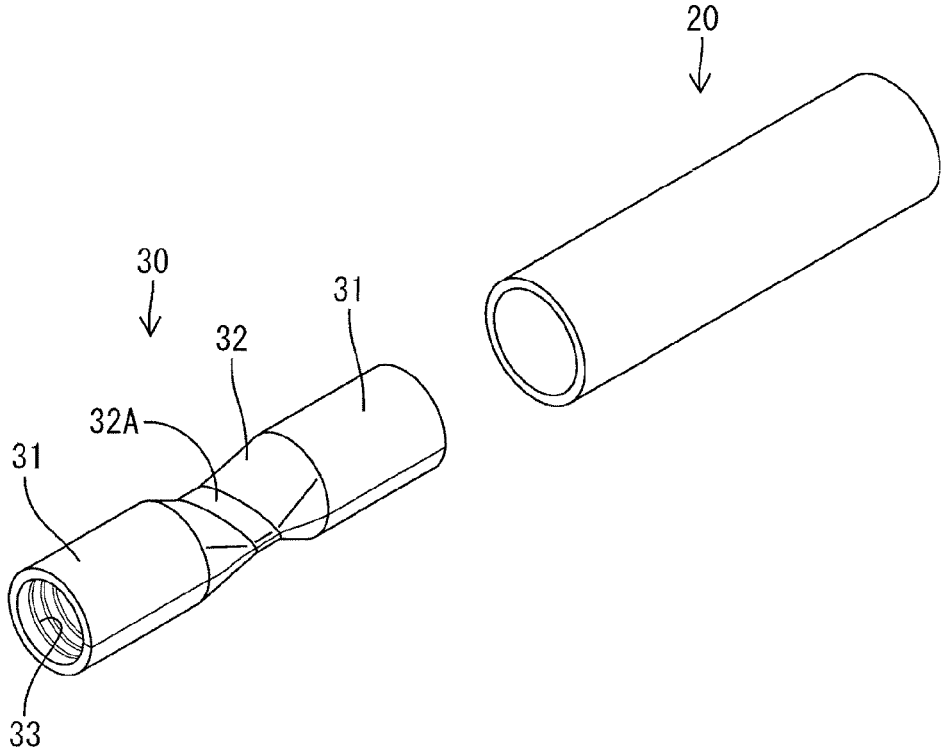
FIG. 4 is a perspective view showing a state before the inner tube is inserted into an outer tube.
Figure 5:
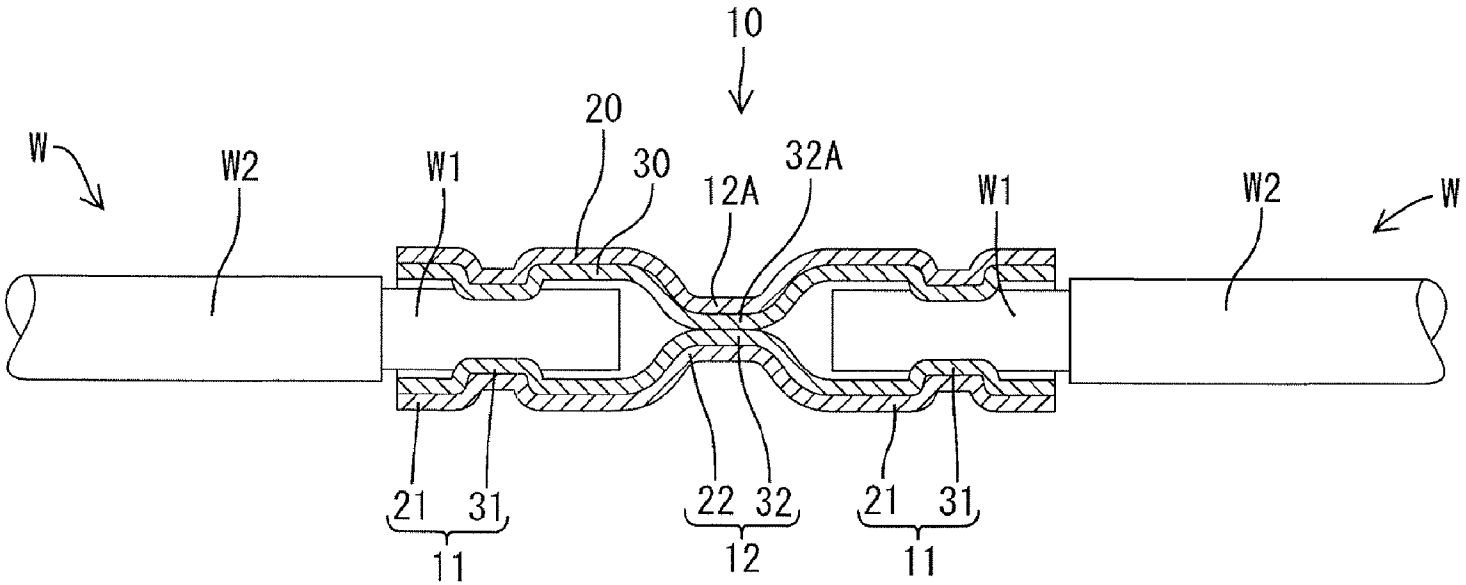
FIG. 5 is a section showing a state where the wires are connected.
Figure 6:
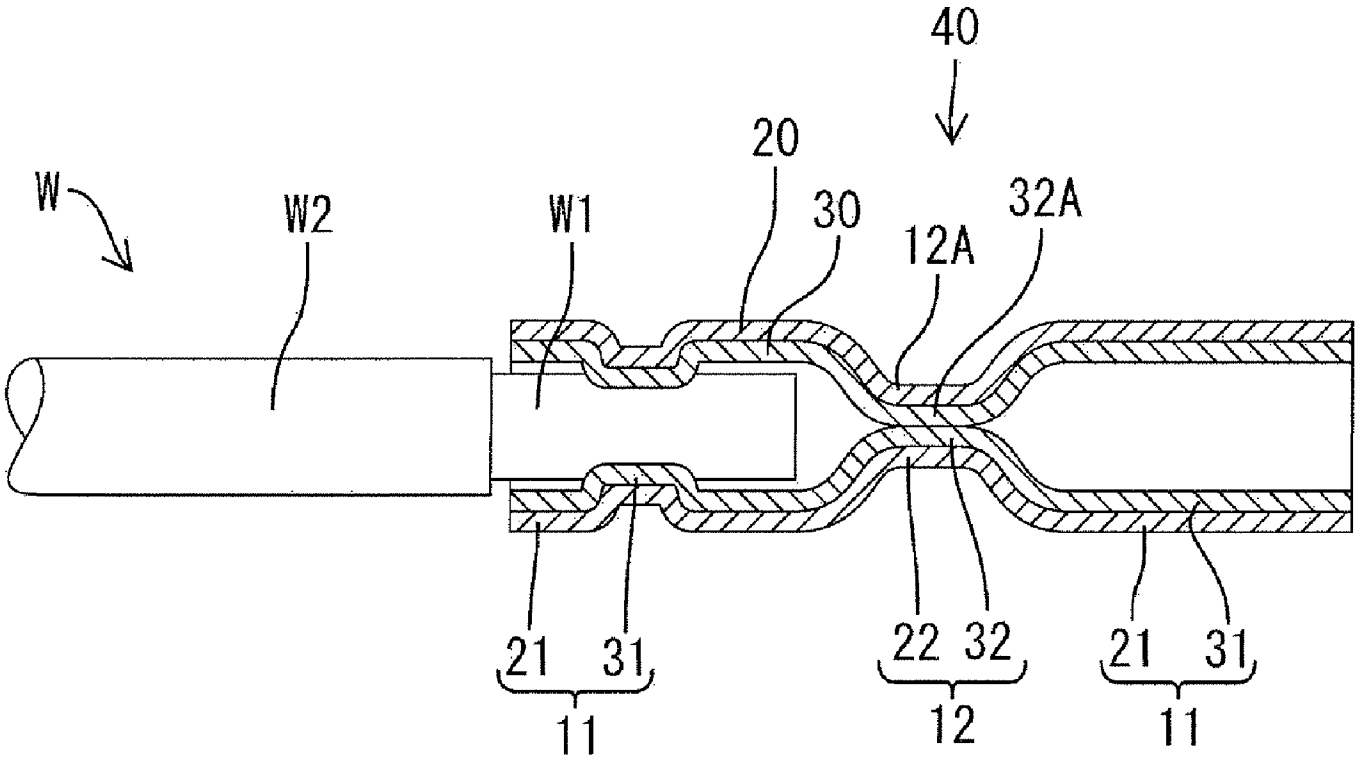
FIG. 6 is a section showing a repair wire.

The inner tube 30 then is inserted into the outer tube 20, as shown in FIG. 4. The intermediate part of the outer tube 20 then is squashed or deformed to form the cross-sectionally small outer-tube portion 22 that protrudes between the two inner-tube wire crimping portions 31 and closely contacts the outer surface of the cross-sectionally small inner-tube portion 32.

The wire connection sleeve 10 can be connected with wires W that have conductors W1 formed by twisting a multitude of strands made of aluminum and/or aluminum alloy. The conductors W1 are covered by insulation coatings W2. However, the insulation coatings W2 are removed at end portions of the respective wires W to expose the conductors W1. The conductor W1 of the one wire W is inserted into one of the two wire crimping portions 11 of the wire connection sleeve 10 and the conductor W1 of the other wire W is inserted into the other wire crimping portion 11. The wire crimping portions 11 then are crimped, bent or deformed into connection with the corresponding conductors W1 (see FIG. 5). As a result, the conductors W1 of the respective wires W are pressed by the inner-tube wire crimping portions 31 and fall into the recesses 33 formed in the inner surfaces of the inner-tube wire crimping portions 31. Opening edges of the recesses 33 abrade or scrape against the conductors W1 to remove oxide films and expose newly formed surfaces. These newly formed surfaces contact the inner-tube wire crimping portions 31 and electrically connect the wires W. In this way, the two wires W are connected electrically via the wire connection sleeve 10. The recesses 33 are not shown in FIGS. 2 and 5.

The repair wire 40 has the wire W crimp-connected with one of the two wire crimping portions 11 of the wire connection sleeve 10 beforehand. However, the other of the two wire crimping portions 11 of this wire connection sleeve 10 is not crimp-connected with a wire W and is substantially open (see FIG. 6). The wire W pre-connected by crimping or deforming and used as the repair wire W may be a copper wire including a conductor made of copper and/or copper alloy or may be an aluminum wire as described above.

The conductor W of the other wire W is inserted into the open wire crimping portions 11 of the wire connection sleeve 10 and the wire crimping portion 11 is crimped into connection with the conductor W1. Thus, the inner-tube wire crimping portion 31 presses the wire W and the conductor W1 enters the recesses 33 in the inner surface of the inner tube 30. The opening edges of the recesses 33 abrade or scrape against the conductor W1 to remove an oxide film formed on the outer surface of the conductor W1 and to expose a newly formed surface. This newly formed surface contacts the inner-tube wire crimping portion 31 to connect the wire W and the repair wire 40 electrically. In this way, the wire connection sleeve 10 electrically connects the wires W.

The wire connection sleeve 10 of this embodiment includes the pipe-like outer tube 20 and the inner tube 30 inserted inside the outer tube 20. The inner tube 20 is formed from metal plate or blank P formed with the recesses 33 in a plate surface. The plate P then is wound into a tubular shape with the both ends being open and the recesses 33 facing in. The longitudinal intermediate part of this inner tube 30 is so squashed or deformed into the cross-sectionally small inner-tube portion 32 to define an opening that is smaller than the openings at the opposite longitudinal ends.

The recesses 33 in the inner surface of the inner tube 30 break open the oxide films of the conductors W1 to expose newly formed surfaces when the conductors W1 of the wires W are inserted into the ends of the inner tube 30 and crimp-connected. The inner tube 30 contacts these newly formed surfaces. Accordingly, contact resistance between the conductors W1 and the inner tube 30 is reduced as compared with the case where the oxide films are present between the conductors W1 and the inner tube 30.

The intermediate part of the inner tube 30 defines the cross-sectionally small inner-tube portion 32 and partitions the two inner-tube wire crimping portions 31. Thus, the conductors W1 of the two wires W cannot be placed one over the other in the inner tube 30. In other words, the inner-tube wire crimping portions 31 can be crimped over the entire circumferences of the conductors W1 of the respective wires W to ensure sufficient contact areas between the inner tube 30 and the conductors W1 of the respective wires W.

Contact resistance between the conductors W1 and the inner tube 30 can be reduced and sufficient contact areas between the conductors W1 of the respective wires W and the inner tube 30 can be ensured. Therefore, connection reliability at the connected parts of the wires W can be improved.

The part of the outer tube 20 located outside the cross-sectionally small inner-tube portion 32 is squashed or deformed to define the cross-sectionally small outer-tube portion 22 that engages the inner-tube wire crimping portions 31 in the longitudinal direction. Thus, the inner tube 30 is held as not to come out of the outer tube 20. As a result, the outer and inner tubes 20 and 30 can be handled together so that the wires W can be connected easily.

The cross-sectionally small inner-tube portion 32 is squashed or deformed until the inner surface thereof is substantially closed. Thus, the conductor W1 of the wire W inserted into the one wire crimping portion 11 reliably is prevented from penetrating into the other wire crimping portion 11.

Figure 7:
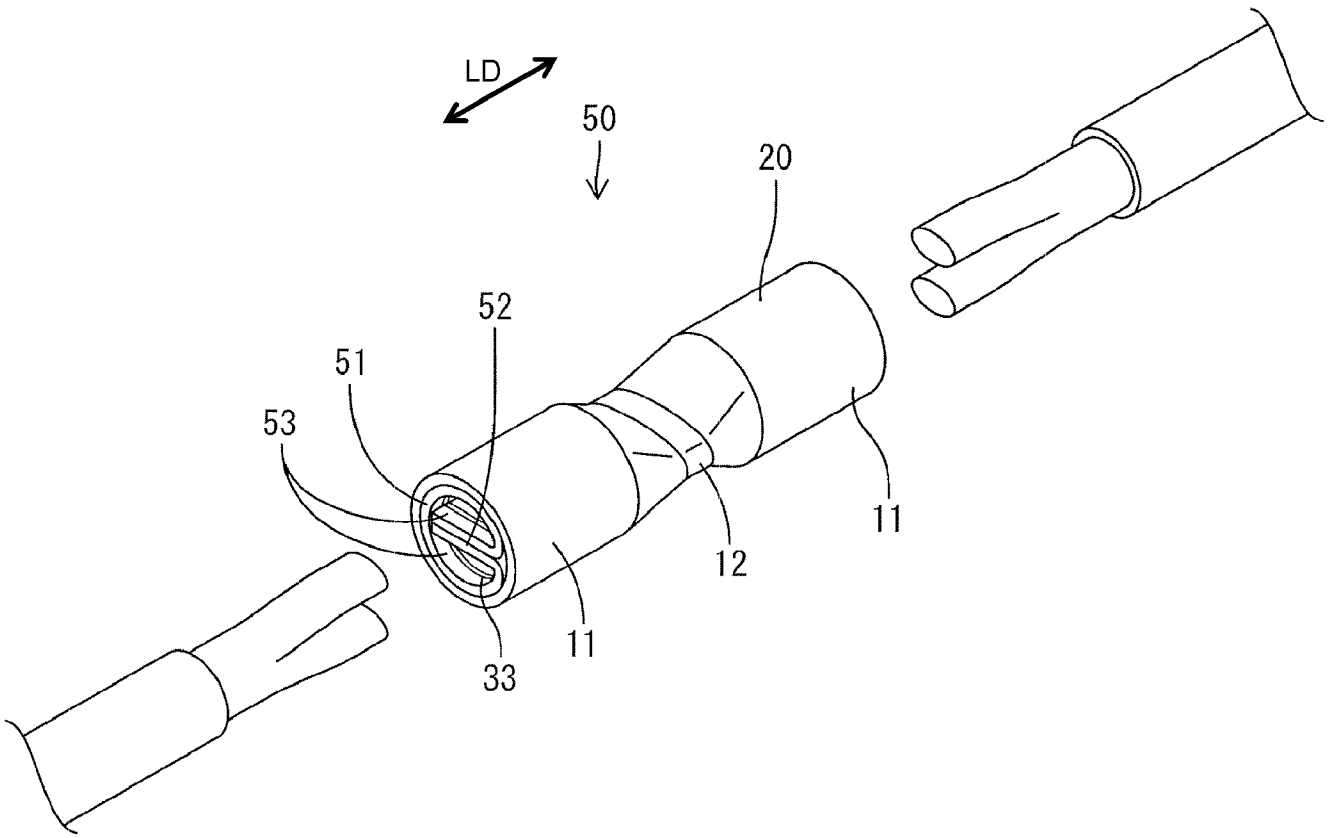
FIG. 7 is a perspective view showing a wire connection sleeve according to a second embodiment and end portions of wires.
Figure 8:
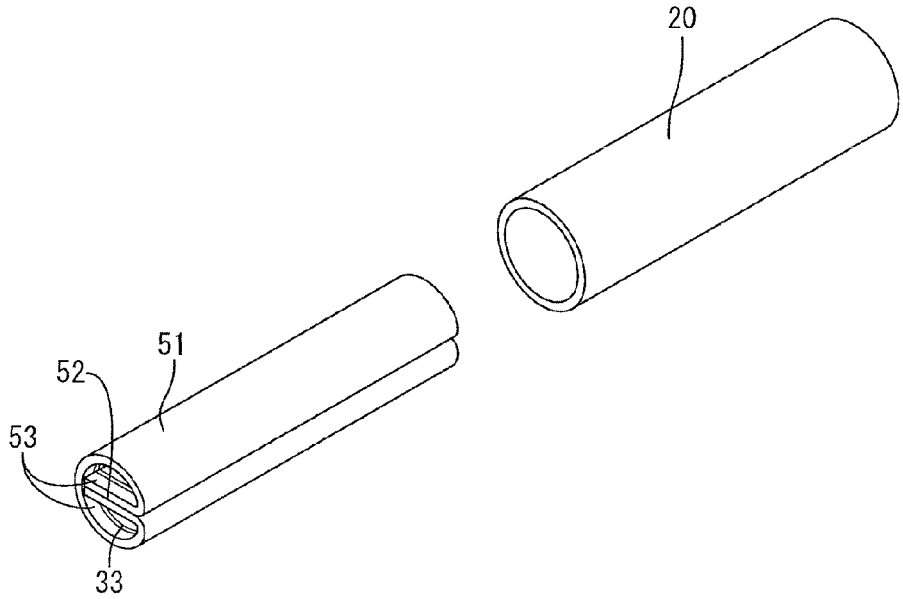
FIG. 8 is a perspective view showing a state before an inner tube is inserted into an outer tube.

A wire connection sleeve 50 according to a second embodiment of the invention is described with reference to FIGS. 7 and 8. Elements of the wire connection sleeve 50 that are the same as or similar to the first embodiment are identified by the same reference numerals and are not described again.

The wire connection sleeve 50 has a double-tube structure composed of an outer tube 20 and an inner tube 51 inserted inside the outer tube 20. The opposite end portions of the wire connection sleeve 50 define wire crimping portions 11 to be crimped or deformed after conductors W1 of wires W are inserted therein. A cross-sectionally small portion 12 is defined at an intermediate part of the wire connection sleeve 50 and has an opening that is smaller than the wire crimping portions 11.

The inner tube 51 is formed from a metal plate P that has recesses 33. The plate P is wound into a substantially tubular shape with both ends open and the recesses 33 facing in. Opposite end portions of the inner tube 51 define inner-tube wire crimping portions 31 that form inner parts of the wire crimping portions 11 and an intermediate part of the inner tube 51 defines a cross-sectionally small inner-tube portion 32 with an opening size that is smaller than the inner-tube wire crimping portions 31.

Folded portions 52 are folded inwardly at the opposite circumferential ends of the inner tube 51. The folded portions 52 cross the inner tube 51 substantially diametrically and surfaces of the folded portions 52 opposite the surfaces with the recesses 33 are held substantially in close contact. The leading ends of both folded portions 52 preferably contact the inner surface of the inner tube 51.

The folded portions 52 partition the interior of the inner tube 51 into two wire insertion spaces 53 in the longitudinal direction LD. The wire insertion spaces 53 at the opposite sides of the folded portions 52 are substantially equally dimensioned. Each wire insertion space 53 is enclosed substantially by the inner surface of the inner tube 51 and the plate surface of the folded portion 52, and the recesses 33 are formed substantially entirely formed in the inner surface of this inner tube 51 and the plate surface of the folded portion 52.

Similar to the first embodiment, the metal plate or blank P is wound so that the recesses 33 face in, thereby forming the inner tube 51 with the both ends being open. Similar to the first embodiment, winding directions of the metal plate P bring the substantially opposite end edges substantially along an extending direction of the recesses 33 closer to each other. Then, the opposite ends of the metal plate P in the winding directions are folded in to form the folded portions 52.

The inner tube 51 then is inserted in the outer tube 20 and, in this state, the longitudinal intermediate part of the outer tube 20 is squashed or deformed to form the cross-sectionally small portion 12. At this time, the outer tube 20 is squashed or deformed until the inner surface of the central part of the cross-sectionally small portion 12 is substantially closed.

Similar to the first embodiment, the conductor W1 of the one wire W is inserted into one of the two wire crimping portions 11 of the wire connection sleeve 50 and the conductor W1 of the other wire W is inserted into the other wire crimping portion 11. At this time, as shown in FIG. 7, the conductor W1 of each wire W is divided substantially into two halves that are inserted respectively into the wire insertion spaces 53 at the opposite sides of the folded portions 52. Similar to the first embodiment, the wire crimping portions 11 then are crimped or deformed into connection with the corresponding conductors W1. The respective parts of the conductors W1 of the wires W inserted into the wire insertion spaces 53 then are pressed and enter the recesses 33 in the inner surface of the inner tube 51 and in the plate surfaces of the folded portions 52. Opening edges of the recesses 33 abrade against and remove the oxide films formed on the outer surfaces of the conductors W1 to expose newly formed surfaces. These newly formed surfaces contact the inner-tube wire crimping portions 31 to connect the wires W and the wire connection sleeve 50 electrically. In this way, the one wire W and the other wire W are connected electrically via the wire connection sleeve 50.

The wire connection sleeve 50 includes the pipe-like outer tube 20 and the inner tube 51 is inserted inside the outer tube 20. The inner tube 51 is formed from the metal plate P that has the recesses 33 in one surface. The metal plate P is wound into a tubular shape with both ends open and the recesses 33 facing in. The longitudinal middle part of the inner tube 51 is deformed into the cross-sectionally small inner-tube portion 32 with an opening size smaller than the openings at the opposite longitudinal ends. The conductors W1 of the wires W are inserted into the both ends of the wire connection sleeve 50 and the wire connection sleeve 50 then is deformation-connected with the conductors. As a result, the recesses 33 in the inner surface of the inner tube 51 break the oxide films of the conductors W1 open to expose the newly formed surfaces and the inner tube 51 contacts these newly formed surfaces. Therefore, contact resistance between the conductors W1 and the inner tube 51 is reduced.

The cross-sectionally small portion 32 at the intermediate part of the inner tube 51 partitions the two inner-tube wire crimping portions 31. Therefore, the conductors W1 of the wires W cannot be placed one over the other and will not interfere with each other in the inner tube 51 during the crimping operation, and sufficient contact areas of the conductors W1 and the inner tube 51 is ensured.

The folded portions 52 are folded in from opposite circumferential ends of the inner tube 51. Thus, the conductors W1 of the wires W can be divided and at the divided parts can be inserted into the wire insertion spaces 53 in the inner tube 51 at the opposite sides of the folded portions 52. Accordingly, the contact areas of the conductors W1 and the inner tube 51 are increased and connection reliability at the connected parts of the wires W is improved further. This structure for increasing the contact areas of the conductors W1 and the inner tube 51 is particularly advantageous for improving the contact reliability of large diameter wires W.

The small-diameter portion 12 of the wire connection sleeve 50 is formed by squashing or deforming the longitudinal intermediate part of the outer tube 20 with the inner tube 51 inserted inside the outer tube 20. The cross-sectionally small inner-tube portion 32 and the cross-sectionally small outer-tube portion 22 can be formed simultaneously in this way. Accordingly, time and labor required for the production can be saved as compared with the case where the cross-sectionally small inner-tube portion 32 and the cross-sectionally small outer-tube portion 22 are formed separately, as in the first embodiment.

The invention is not limited to the above described and illustrated embodiments. For example, the following embodiments are also included in the technical scope of the present invention.

The opposite circumferential ends of the inner tube 51 are folded inwardly to form the folded portions 52 in the second embodiment. However, only one end may be folded in to form the folded portion. In such a case, it is better to form projections or recesses on or in both plate surfaces of a part of the metal plate to become the folded portion.

The operation of connecting two aluminum wires W using the wire connection sleeve 10 (50) is described above. However, the invention may be used to connect wires with conductors made of copper and/or copper alloy. Alternatively, an aluminum wire and a copper wire may be connected with effects similar to those described above.

The above-described inner tube 30 (51) is formed by winding the metal plate P into the tubular shape with the recesses 33 facing in and both ends being open. However, the inner tube may be formed by winding any sheet-like metal material formed with projections or recesses. For example, it may be formed by winding a sheet-like braided wire formed by weaving a plurality of metallic thin wires into a mesh.

The inner tube 30 (51) is prevented from being separated from the outer tube 20 by engaging the outer-tube small-diameter portion 22 and the inner-tube wire crimping portions 31 in the longitudinal direction LD in the above embodiments. However a separate restricting member may be provided to prevent detachment of the inner tube by engaging the outer tube and the inner tube.

The recesses 33 are formed substantially in the entire inner surface of the inner tube 30 (51) in the above embodiments. However, recesses or projections may be at least in or on the inner surfaces of the inner-tube wire crimping portions of the inner surface of the inner tube.

Figure 9:
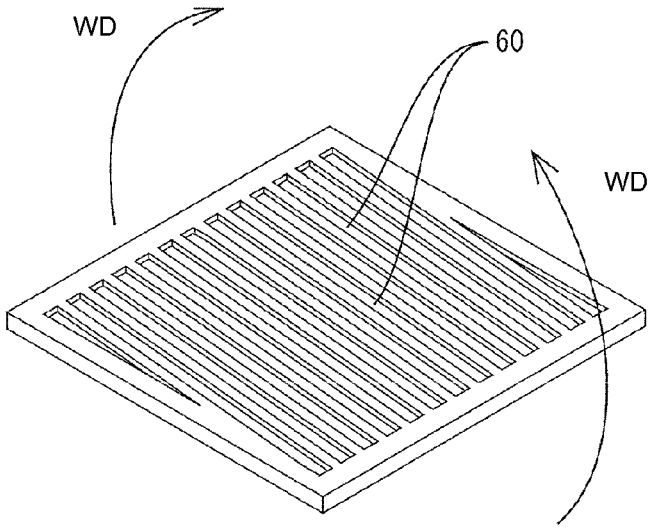
FIG. 9 is a perspective view showing a metal plate before being formed into an inner tube according to another embodiment (6).

The grooves extend in the circumferential direction of the inner tube 30 (51) to form the recesses 33 in the inner surface of the inner tube 30 (51) in the above embodiments. However, the form of the projections or recesses in the inner surface of the inner tube does not matter. For example, as shown in FIG. 9, grooves 60 extend in a direction oblique to the circumferential direction of the inner tube. A metal plate before being formed into an inner tube is shown in FIG. 9 and winding directions WD are shown by arrows.

Figure 10:
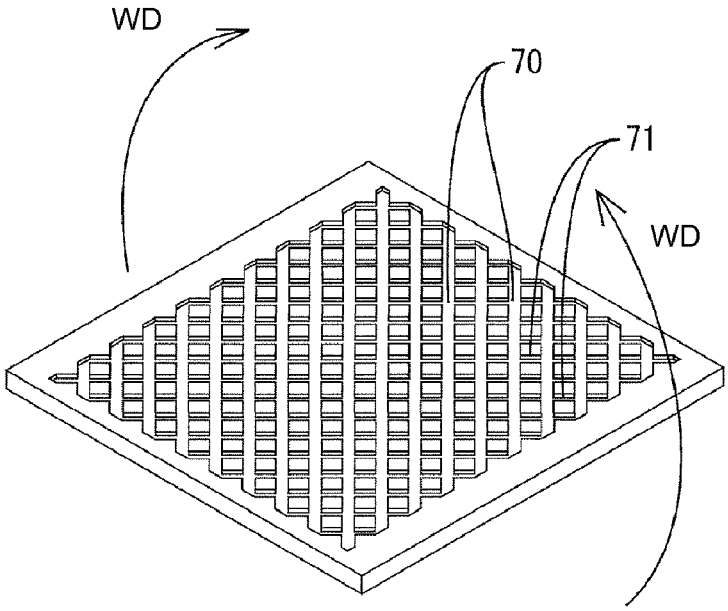
FIG. 10 is a perspective view showing a metal plate before being formed into an inner tube according to another embodiment (7).

The grooves extend in the circumferential direction of the inner tube 30 (51) to define the recesses 33 in the inner surface of the inner tube 30 (51) in the above embodiments. However, the form of the projections or recesses does not matter. For example, as shown in FIG. 10, grooves 70 extending in a first direction oblique to the circumferential direction of the inner tube and grooves 71 extending in a second direction oblique to the circumferential direction of the inner tube may cross each other. A conductive or metal plate before being formed into an inner tube is shown in FIG. 10 and winding directions WD are shown by arrows.

Figure 11:
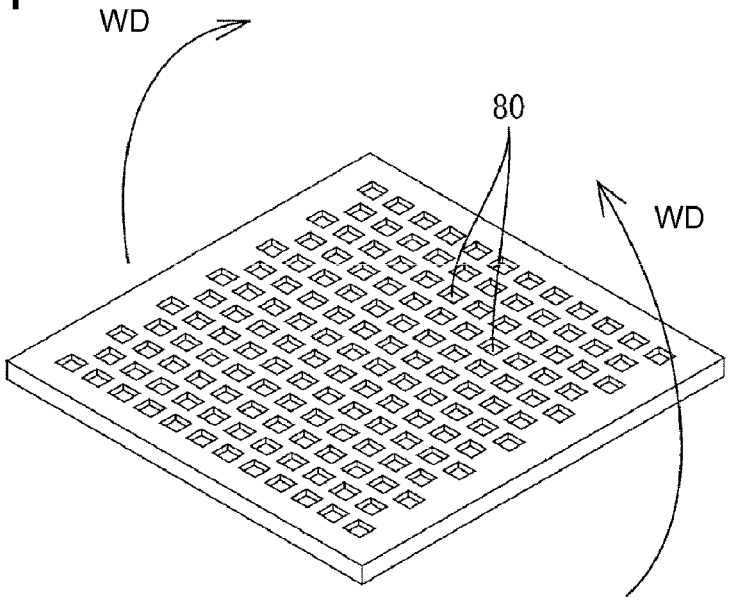
FIG. 11 is a perspective view showing a metal plate before being formed into an inner tube according to another embodiment (8).
Figure 12:
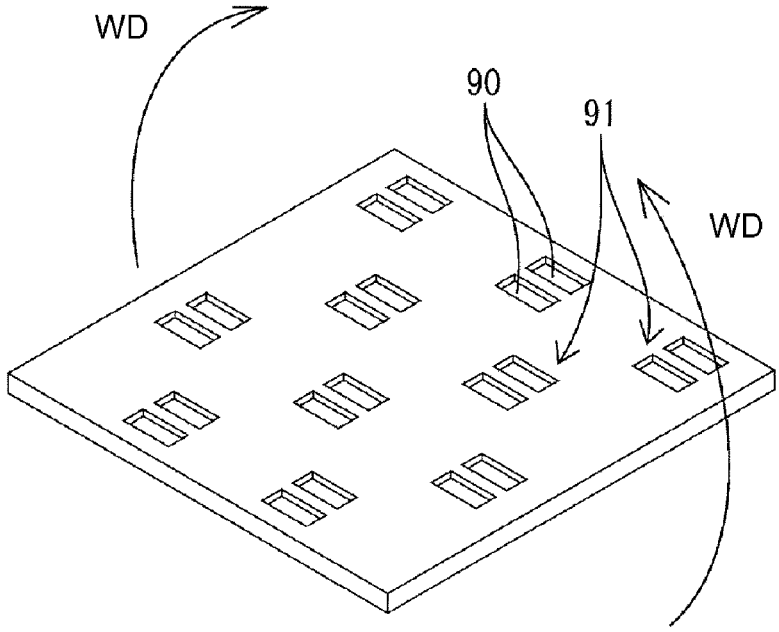
FIG. 12 is a perspective view showing a metal plate before being formed into an inner tube according to another embodiment (9).
Figure 13:
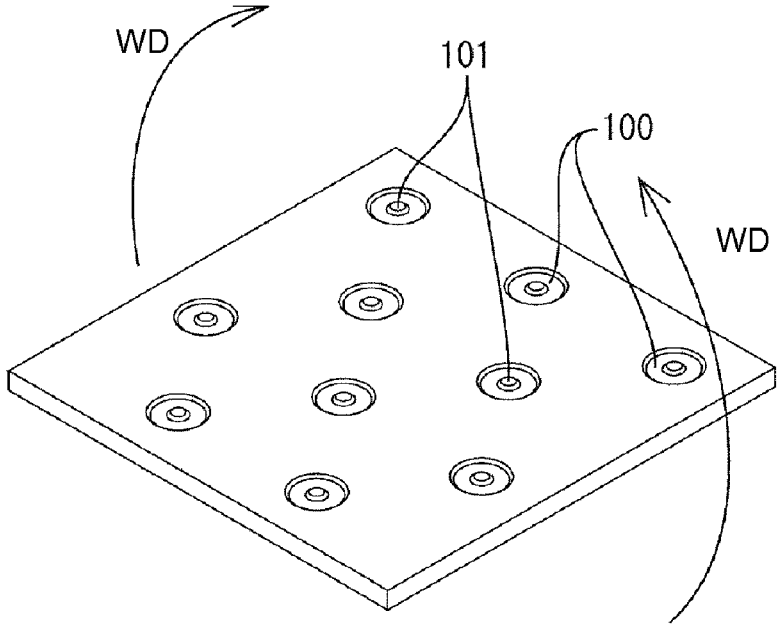
FIG. 13 is a perspective view showing a metal plate before being formed into an inner tube according to another embodiment (10).

Grooves extending in the circumferential direction of the inner tube 30 (51) are formed as the recesses 33 in the inner surface of the inner tube 30 (51) in the above embodiments. However, the form of the projections and/or recesses on or in the inner surface of the inner tube does not matter. For example, as shown in FIG. 11, dot-like recesses 80 may be arranged at intervals in the circumferential and longitudinal directions LD of the inner tube. A metal plate before being formed into an inner tube is shown in FIG. 11 and winding directions WD are shown by arrows. Additionally, as shown in FIG. 12, a plurality of recess groups each composed of a pair of recesses formed side by side in the longitudinal direction LD of the inner tube may be formed at intervals. A metal plate before being formed into an inner tube is shown in FIG. 12 and winding directions WD are shown by arrows. As shown in FIG. 13, dot-like recesses 100 may be arranged at intervals in the circumferential and longitudinal directions LD of the inner tube and projections 101 may be formed at intermediate position of the respective recesses 100. A metal plate before being formed into an inner tube is shown in FIG. 13 and winding directions WD are shown by arrows.

It should be understood that even though the metal plates P have been described as having one kind of projection and/or recess, the metal plate P may be configured with any combination of the above disclosed kinds of projections and/or recesses.

What is claimed is:

1. A wire connection sleeve, comprising:

a substantially pipe-like outer tube; and an inner tube inserted in the outer tube, the inner tube having opposite first and second open ends and an inner surface having projections or recesses, a folded portion extending diametrically across the inner tube so that a leading end of the folded portion contacts the inner surface of the inner tube and divides the inner tube substantially diametrically into two wire insertion spaces located at opposite sides of the folded portion, the folded portion further extending substantially from the first open end to the second open end of the inner tube, a longitudinal intermediate part of the inner tube being squashed to define a cross-sectionally small inner-tube portion that is cross-sectionally smaller than the opposite ends of the inner tube.

2. The wire connection sleeve of claim 1, wherein a part of the outer tube outside the cross-sectionally small portion of the inner tube defines as a cross-sectionally large outer-tube portion that is squashed sufficiently to engage the inner tube in a longitudinal direction.

3. The wire connection sleeve of claim 1, wherein the projections or recesses are elongated projections or grooves extending in a substantially circumferential direction of the inner tube.

4. The wire connection sleeve of claim 1, wherein the cross-sectionally small inner-tube portion is substantially closed.

5. The wire connection sleeve of claim 1, wherein opposite longitudinal ends of the cross-sectionally small inner-tube portion are formed into two wire crimping portions to be crimped into connection with respective wires.

6. The wire connection sleeve of claim 4, wherein the wire crimping portions have substantially equal opening sizes and longitudinal lengths, and wherein the opening size of the wire crimping portions is substantially constant in a longitudinal direction.

7. A repair wire pre-connected with the wire connection sleeve of claim 1, wherein:

at least one conductor of at least one wire is crimped into connection with a first end of the inner tube, and a second end of the inner tube is open.

8. A method for producing a wire connection sleeve, comprising:

providing a conductive sheet material formed with projections and recesses;

winding the sheet material into an inner tube with an inner surface and opposite first and second open ends, the winding of the sheet material including folding a portion of the inner tube inwardly to form a folded portion extending diametrically across the inner tube so that a leading end of the folded portion contacts the inner surface of the inner tube, the folded portion further extending substantially from the first open end to the second open end of the inner tube and dividing the inner tube substantially diametrically into two wire insertion spaces located at opposite sides of the folded portion;

inserting the inner tube into an outer tube; and squashing a longitudinal intermediate part of the outer tube to form a cross-sectionally small inner-tube portion in an intermediate part of the inner tube that is cross-sectionally smaller than the open ends of the inner tube and forming a cross-sectionally small outer-tube portion engaged with the inner tube in a longitudinal direction substantially in a part of the outer tube located outside the cross-sectionally small inner-tube portion.

9. A wire connecting method for connecting first and second wires, the method comprising:

providing a wire connection sleeve with an outer tube, an inner tube in the outer tube, projections or recesses being formed on an inner surface of the inner tube, the inner tube including a folded portion extending substantially between opposite longitudinal ends of the inner tube and diametrically across the inner tube so that a leading end of the folded portion contacts the inner surface of the inner tube and the folded portion divides the inner tube substantially diametrically into two wire insertion spaces located at opposite sides of the folded portion, opposite first and second ends of the inner tube being open and a longitudinal intermediate part of the inner tube being squashed to define a cross-sectionally small inner-tube portion that is cross-sectionally smaller than the open first and second ends of the inner tube;

dividing conductors of the first wire into groups of conductors and inserting the groups of the conductors into the first open end of the inner tube respectively at opposite sides of the folded portion;

dividing conductors of the second wire into groups of conductors and inserting the groups of the conductors into the second open end of the inner tube respectively at opposite sides of the folded portion; and crimping the wire connection sleeve so that the projections or recesses of the inner tube securely engage the conductors of the respective first and second wires.

10. The wire connecting method of claim 9, wherein the conductors of the wires are made of aluminum and/or aluminum alloy.

* * * * *